United States Patent [19]

Meier

[11] Patent Number: 4,709,470

[45] Date of Patent: Dec. 1, 1987

[54] METHOD AND APPARATUS FOR FABRICATING A CURVED MAGNET COIL

[75] Inventor: Konrad Meier, Erlangen, Fed. Rep. of Germany

[73] Assignee: Siemens Aktiengesellschaft, Munich, Fed. Rep. of Germany

[21] Appl. No.: 820,205

[22] Filed: Jan. 17, 1986

[30] Foreign Application Priority Data

Feb. 7, 1985 [DE] Fed. Rep. of Germany ..... 3504211

[51] Int. Cl.[4] ..... H01F 41/06

[52] U.S. Cl. ..... 29/605; 156/173; 242/7.03; 242/7.05 R

[58] Field of Search ..... 29/605, 606; 242/7.03, 242/7.05; 156/173-175, 180; 140/92.1, 92.2

[56] References Cited

U.S. PATENT DOCUMENTS 4,448,054 5/1984 Wayne ..... 29/605 X 4,547,238 10/1985 Lenders ..... 29/606 X

OTHER PUBLICATIONS

Fuji Electric Review, vol. 19, No. 3, 1973, pp. 112-118.

IEEE Trans. on Nuclear Science, vol. NS-30, No. 4, Aug. 1983, pp. 2531-2533.

*Primary Examiner*—Carl E. Hall

*Attorney, Agent, or Firm*—Kenyon & Kenyon

[57] ABSTRACT

A method and apparatus for fabricating a curved disc-shaped magnet coil, especially for particle accelerators. The conductor is wound around a coil form which has a convex outside and a concave inside with therefore a partly negative curvature, using elements pressing the conductor onto the inside of the coil form or the conductor turns already in place. The conductor is fixed in its position after the winding process. In order to wind the magnet coil quasi continuously, the conductor is applied to the coil form or the conductor turns already present under tension in the region of the convex outside and, in the region of the concave inside, pressure elements are provided which are guided along on the inside and wind the conductor under relatively reduced tension. The pressure elements are spaced from each other at least largely regularly, exert a predetermined radial pressure, and are held there until the conductor is fixed in position.

11 Claims, 3 Drawing Figures

METHOD AND APPARATUS FOR FABRICATING A CURVED MAGNET COIL

BACKGROUND OF THE INVENTION

The present invention relates to a method for fabricating a curved disc-shaped magnet coil, especially for particle accelerators, the conductors of which are wound around a coil form which has a convex outside and a concave inside and therefore, with a partially negative curvature, using elements pressing the conductor onto the inside of the coil form and the conductor turns already placed there, and which are secured in position after the winding process. The invention further relates to an apparatus for carrying out this method.

A similar superconducting magnet coil is known, for instance, from the literature reference "Fuji Electric Review", vol. 19, no. 3, 1973, pages 112–118. This coil, wound with superconductors, is curved along a length of circular arc with predetermined radius and predetermined arc angle, so that it has a convex outside and a concave inside. This magnet coil, the conductors of which are fixed in their geometric position by struts between these sides, is to serve as a lifting magnet for the contactless suspension guidance of a vehicle along a track.

Also in particle accelerators, storage rings for charged particles such as electrons must have corresponding curved dipole magnets due to their curved particle tracks. These magnets can be formed particularly in the shape of semicircles (see, for instance, "IEEE Transactions on Nuclear Science", vol. NS-30, no. 4, August 1983, pages 2531 to 2533) Because of the required high field intensities, superconducting windings are preferred for this purpose. In order to guarantee an unchanged position of the turns of these windings to be fabricated from corresponding conductors, these turns must first be wound around a suitably shaped coil form and fastened to the same. In this connection, however, the problem arises of winding with a negative radius of curvature in the region of the concave insides of the coil forms.

Magnets, the windings of which have negative curvature, can be fabricated, for instance, by laying the at least one conductor in slots without tension, and subsequent wedging. Also known is the successive clamping of the conductor, using special pressure elements such as individual clamps which can be attached to the outer edge of the coil form in stationary relationship. The conductor segments clamped by these elements must then be fixed piece by piece to the coil form and if applicable, to conductor turns already placed there, for instance, by cementing. Such winding techniques, however, are very complicated and time-consuming, especially for superconducting dipole magnets of storage rings.

SUMMARY OF THE INVENTION

It is, therefore, an object of the present invention to provide a method with which the fabrication on a large technical scale of disc-shaped curved magnet coils is made possible in a relatively simple manner, and where, in particular, superconducting conductors can be provided.

The above and other objects of the present invention are achieved by the provision that the conductor is put in place under tension at the coil form or the conductor turns already present there in the region of the convex outside and are added in the region of the concave inside under relatively reduced tension by means of pressure elements which can be brought along on this side, are spaced from each other at least largely regularly and exert a predetermined radial pressure force, and are held there until fixed.

The advantages connected with this embodiment of the method are in particular that, due to the use of a multiplicity of lined-up pressure elements which are arranged movably along the concave inside of the coil form, a quasi-continuous winding process is made possible by laying the conductor against the coil form with one of these elements and holding it against the same by subsequent elements. In this manner, a coil with negative curvature can be formed without the need for a special, generally very extensive stationary holder of individual parts of the turns during the winding process.

The method according to the invention can be carried out advantageously with a device which is characterized by the features that each pressure element has a device with a pressure roller for pressing the conductor from the outside against the concave inside and that the pressure elements are fastened in spoke-fashion to a support part supported rotatably about the center of the radius of curvature of this inside.

BRIEF DESCRIPTION OF THE DRAWINGS

The invention will be explained in greater detail in the following detailed description with reference to the drawings, in which.

DETAILED DESCRIPTION

Figure 1:
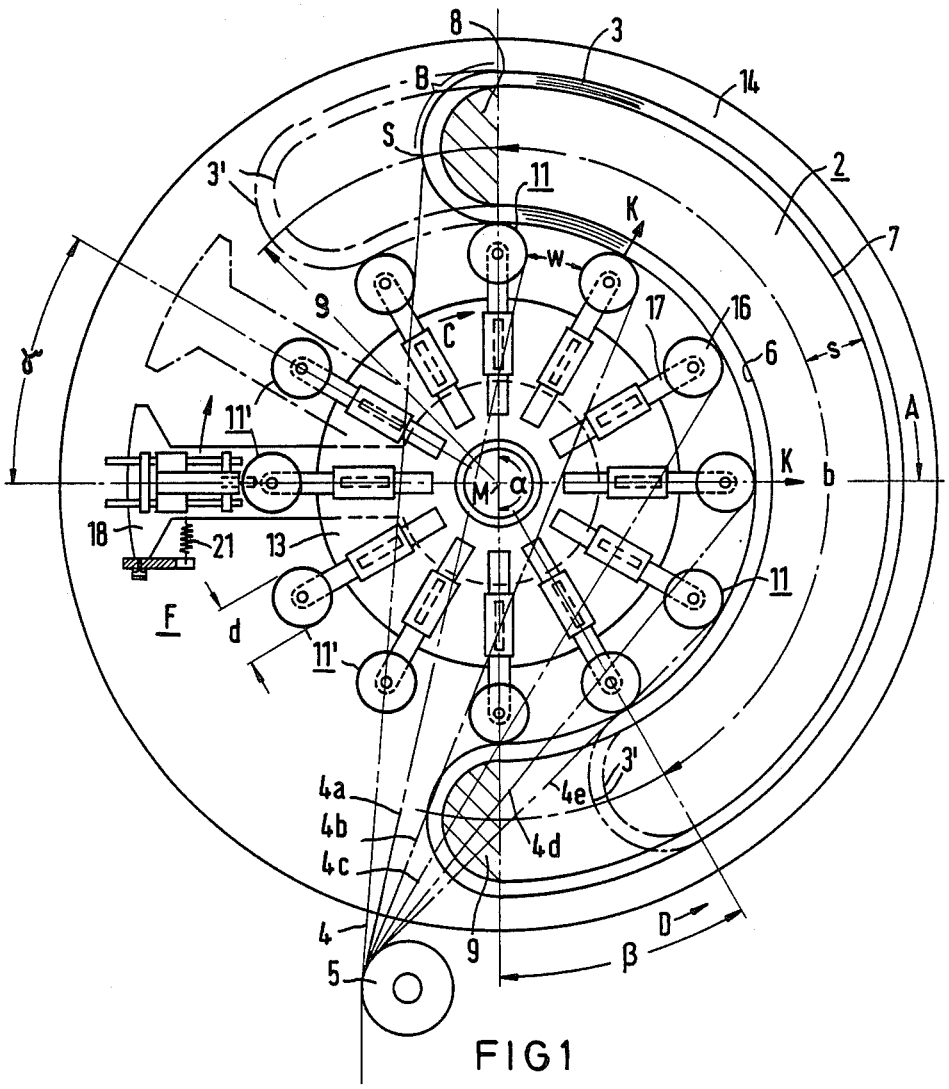
FIGS. 1 and 2 show a device for carrying out the method according to the invention in schematic views.

With reference now to the drawings, FIG. 1 shows, in a top view, a flat coil form 2 such as can be provided, for instance, for fabricating a flat dipole magnet coil for an electron storage ring. This coil form, according to the view in the figure, is already provided with part of the winding 3. The winding must be fabricated from at least one flat and in particular, superconducting conductor 4 which is taken from a supply reel, not shown in the figures, and is fed, for winding the inside contour of the coil form, via a deflection roll 5, to the part region of the coil form to be wound there and to the partial winding 3 already applied to it. The coil form 2 which extends along a predetermined length of arc b with an arc or radius of curvature $\rho$ has a constant width of $2\times s$. The quantity s is the distance of the arc line b from the two concentrically curved long sides 6 and 7 of the winding core 2. This constant width of the winding core extends generally over a length of arc $\pi\alpha\rho/180°$, where $\alpha$ is the arc angle measured in degrees. According to the embodiment shown, $\alpha$ has a value of 180°. The ends 8 and 9 on the end faces of the coil form 2 are formed by semi-circles with diameters of $2\times s$ each. Thus, the convex outside 7 to be wound is thus connected via the semi-circles to the concave inside 6 of the coil form 2 to be wound.

Figure 2:
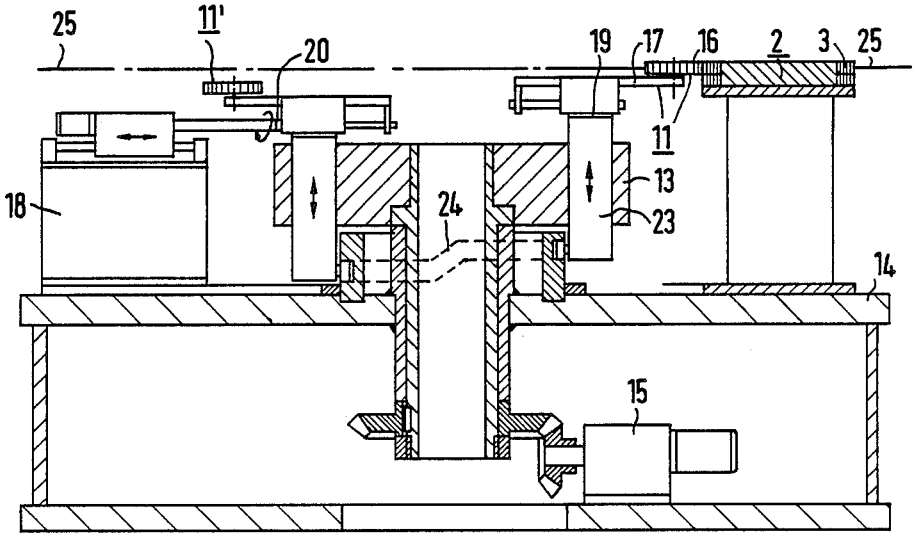

According to the invention, the outside contour of the coil form 2 which is curved in this manner and fastened on a winding table 14 is now to be wound at a relatively high winding tension and the inner contour quasi continuously at a greatly reduced winding tension, with at least one conductor 4. For this purpose, special pressure elements 11 are provided, which are to be brought along the concave inside 6 of the coil form and are regularly spaced from each other. By means of these elements 11, a predetermined radial contact pressure K is exerted on the respective part of the conductor 4, so that the latter is held at the concave inside 6 of the coil form 2 or immovably at the conductor turns already applied there until the fabricated complete winding has been fixed in its position. The winding device provided for this purpose is shown in the top view of FIG. 1 as well as from the corresponding cross section of FIG. 2.

For winding with this device, a support part 13 is rotatably supported in the winding table 14 at the radius center M of the cruved disc-shaped winding 3 or its coil form 2, and is equipped with a drive 15. This support part is shaped like a plate, since the individual pressure elements 11 are fastened thereto in the manner of spokes, i.e., radially outward pointing, and since each of these elements 11 comprises a roll, the plate-like support part can also be called a roll plate.

So as to wind the conductor 4 under appropriately high winding tension onto the positively curved, i.e., convex outside 7 of the coil form 2, the winding table 14 is rotated into the direction indicated by an arrow designated with A, until the "stop" position shown in FIG. 1 is reached. In this position, the conductor 4 to be unwound from the supply reel rests tangentially approximately at the outermost apex S of the semi-circular end piece 8 of the coil form 2. The turns already wound on the coil form are held immovably also in the region of the end piece 8 designated with B which extends from the apex S to the start of the outside 7 of the coil form, due to the high winding tension and optionally, an additionally set clamp.

After winding beyond the apex S, the winding tension is reduced greatly and the conductor 4 is progressively laid into the negative curvature of the winding 3 by means of a pressure element 11 while the remaining elements 11 serve only for holding the conductor in the region of the concave inside 6. For this purpose, the roll plate 13 supporting the pressure element is rotated in a direction of rotation illustrated by an arrow designated with C. The resulting progressive guidance of the conductor 4 which is to be put in place and which runs over the deflection roll 5 is indicated in FIG. 1 by dashed lines *4a, 4b, 4c,* etc.

For holding the conductor 4 on the inside 6 of the coil form 2 or the conductor turns of the partial winding 3 already applied there, the pressure elements 11 which must be provided for this purpose in appropriate numbers, contain a pressure roll 16 which is fastened to the radially outer end of a roll arm 17. As can be seen particularly from FIG. 2, the roll arms 17 are radially movable. They are each adjusted in a so-called free zone F, in which individual pressure elements, designated there with 11' protrude radially free to the outside, i.e., do not come into contact with the inside contour of the coil form 2, via a setting device 18 to the radial dimension reduced by the conductor thickness of the conductor turn put in place last. An elastic intermediate member 19 which is effective only in the radial direction, provides for tolerance equalization and uniform contact pressure K aqainst the inside winding contour of the concave inside 6. The setting device 18 is taken along in the circumferential direction by the roll plate 13 for coupling to a control drive 20 in the range of rotation designated in FIG. 1 by an angle $\gamma$, is released at the end of the setting process and is swung back into its starting position by a tension spring 21. The angle of rotation $\gamma$ corresponds here to the arc angle enclosed, for instance, between two adjacent pressure elements.

All pressure elements not enclosed by the negative curvature in the free zone F which are designated with 11', are brought into position by slides 23 vertically on a curved track 24, i.e., in this free zone F, the pressure elements are lowered below the conductor plane 25 indicated by a dash-dotted line. This is necessary because, when winding in the head region B of the coil form end piece 8, the conductor 4 intersects with this plane. During the winding of the negative curvature, the conductor 4 is guided over the deflection roll 5 which can likewise be lowered. At the same time, the winding table 14, which also carries the coil form 2, is rotated counterclockwise by an angle $\beta$ into the direction shown in FIG. 1 by a line D with arrows. The angle of rotation $\beta$ can correspond, for instance, to one or several-times the arc angle between two adjoining pressure elements. In this manner, a collision of the conductor with the winding can be prevented in this region and in addition, the guidance of the conductor when leaving the pressure rolls is improved. The position of the coil form or its partial winding occupied after this rotation is indicated in this figure by dashed lines designated with 3'.

The conductor turns of the winding made in this manner are finally secured in their intended position in a manner known per se, for instance, by cementing them to each other and to the coil form.

In the winding device shown in FIG. 1, for carrying out the method according to the invention, only 12 radially outward-pointing pressure elements 11 and 11' were assumed, the distance formed between adjacent elements having a relatively large width w. Generally, however, the distances will be chosen considerably smaller so that the conductor 4 can be held securely on the inside 6 of the coil form. Since at the same time a large number of holding or pressure points is advantageous, a correspondingly larger number of pressure elements must be provided, with a relatively small diameter d of the pressure rolls 16.

Figure 3:
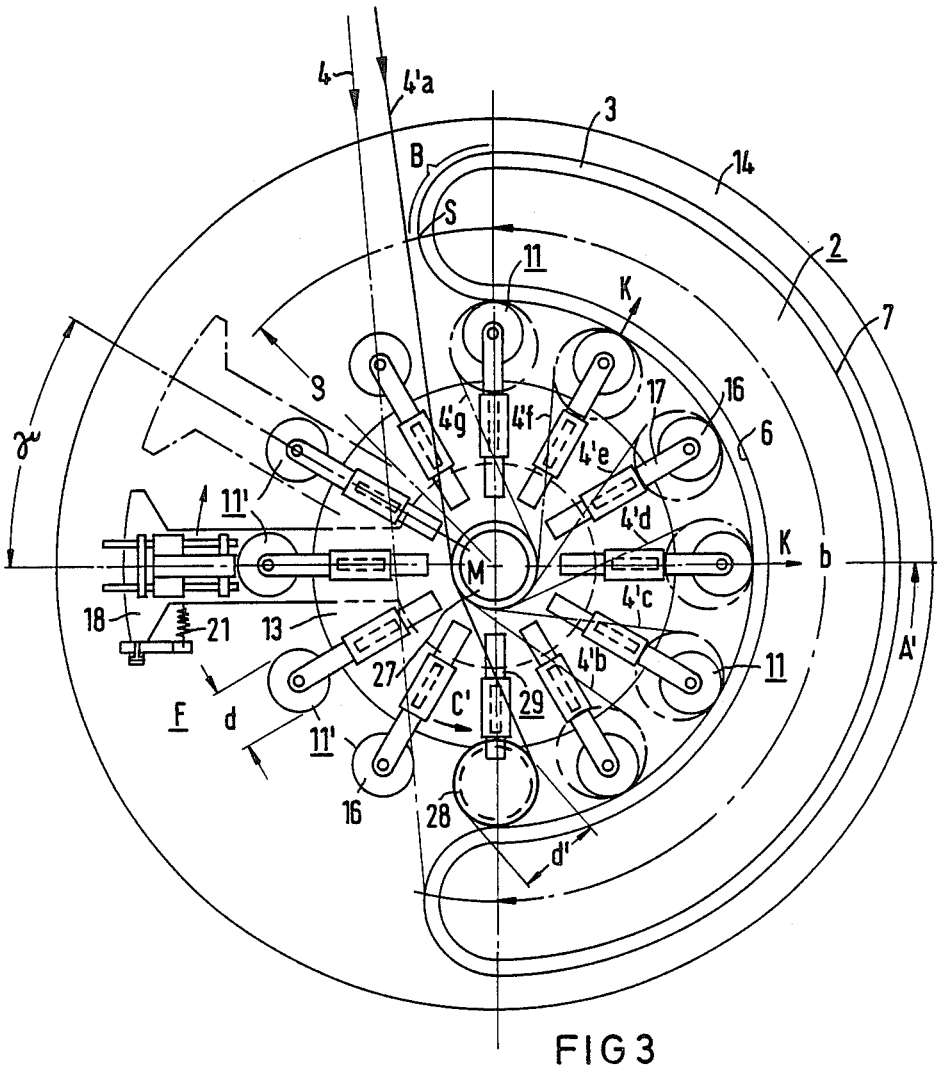
FIG. 3 shows a further device according to the invention in a view corresponding to FIG. 1. Like parts in the figures are provided with like reference symbols.

FIG. 3 shows a further winding device which largely corresponds to the device shown in FIG. 1. This winding device differs from the device according to FIG. 1 essentially only by the changed conductor arrangement. The conductor 4 is brought, for winding on the inside 6 of the coil form 2 or the conductor turns already in place of a partial winding 3, over a deflection roll 27 which is now arranged centrally and over the pressure roll 28 of a pressure element 29 against the corresponding inside contour. In order to limit the bending stress of the conductor, the diameter d' of this roll is chosen relatively large as compared to the diameter d of the pressure rolls 16 of the remaining pressure elements 11 and 11'. The pressure elements 11 serve only for holding the conductor against the inside contour. In the figure, the progressive winding of the inside contour is furthermore indicated by corresponding individual positions of the roll 28 or the conductor by dashed lines, where advantageously, a counter rotation of the winding table as in the device according to FIG. 1 is no longer required. The individual conductor positions are designated with 4'a to 4'g. The directions of rotation A' and C' of the winding table 14 or, the roll plate 13 are reversed relative to the corresponding directions of rotation A and C of the device according to FIG. 1.

In the winding devices according to the invention, all drives of the setting members can be realized mechanically as well as hydraulically or pneumatically. The control of all movements in the course of the winding process is accomplished, for instance, by an electronically controlled timing control. The motion cycles can be controlled, however, via program and NC controls because therefore, intervention by program changes is possible in a simple manner.

As shown, particularly in FIGS. 1 and 3, the embodiments of the winding device are based on a curved coil form 2, the angle of arc $\alpha$ of which is chosen to be 180°. Magnet coils of similar shape are provided particularly for storage rings of electron accelerators. With the method according to the invention and the corresponding apparatus, however, also curved coil forms with smaller angles of arc can be wound in a similar manner.

With the method according to the invention and the corresponding apparatus, also so-called double discs can advantageously be fabricated on a large technical scale in a relatively simple manner by assembling the former from individual discs in accordance with the described embodiments.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A method for fabricating a curved disc-shaped magnet coil, the conductor of which is wound around a coil form having a convex side and a concave side with a therefore partly negative curvature, comprising the steps of utilizing means for winding and simultaneously pressing the conductor onto the concave side of the coil form or onto conductor turns already put in place on said concave side, and fixing the conductor in position after the winding process is complete, and further comprising the step of winding said conductor on the coil form or the conductor turns already present in the region of the convex side under tension, said step of utilizing comprising winding in the region of the concave side with relatively reduced tension with a plurality of pressure exerting means which can be moved along said concave side, said pressure exerting means being spaced substantially regularly and exerting a predetermined radial pressure, said pressure exerting means being held in position until said conductor is fixed in position on said coil form by at least one of mechanically, pneumatically or hydraulically operating means.

2. The method recited in claim 1, wherein at least one superconducting conductor is placed on the coil form.

3. The method recited in claim 1, wherein the magnet coil is built up from one or several flat windings around the coil form.

4. Apparatus for fabricating a curved disc-shaped magnet coil, the conductor of which is wound around a coil form having a convex side and a concave side with a therefore partly negative curvature, comprising means for winding and simultaneously pressing the conductor on the concave side of the coil form or onto the conductor turns already put in place on said concave side, said means for winding and pressing comprising a plurality of pressure exerting means which can be moved along on said concave side, said conductor being wound on the coil form or the conductor turns already present in the region of the convex side under tension and being wound in the region of the concave side with relatively reduced tension by said pressure exerting means, said pressure exerting means being spaced substantially regularly and exerting a predetermined radial pressure, said pressure exerting means being held in position until said conductor is fixed in position, said pressure exerting means comprising a plurality of pressure roll means for pressing the conductor onto the concave side, said pressure roll means being fastened in spoke-fashion to a support means rotatably mounted about a center of the radius of curvature of the concave side, said support means and coil form being disposed on a winding table which is optionally movable on a circular track concentric about said center of the radius of curvature of the concave side.

5. The apparatus recited in claim 4 wherein the pressure exerting means located in a region outside of the region defined by the coil form are lowered vertically below a winding plane of said conductor relative to the pressure exerting means acting on the coil form.

6. The apparatus recited in claim 4, wherein each pressure exerting means comprises a roll arm having a pressure roll on a radially outer end thereof, said pressure roll being movable radially.

7. The apparatus recited in claim 4, wherein each pressure exerting means comprises an elastic intermediate member which is effective only in the radial direction.

8. The apparatus recited in claim 6, wherein one of the pressure rolls of one of the pressure exerting means which lays the conductor against the concave side of the coil form or the conductor turns already in place, has a larger diameter than the pressure rolls of the remaining pressure exerting means.

9. The apparatus recited in claim 5, further comprising deflection roll means for feeding the conductor to the pressure exerting means laying the conductor against the concave side of the coil form or the conductor turns already applied.

10. The apparatus recited in claim 9, wherein the deflection roll means is fastened rotatably at the center of the radius of curvature of the concave side of the coil form.

11. The apparatus recited in claim 9, further comprising means for lowering the deflection roll means below the conductor winding plane of said conductor.

* * * * *